United States Patent [19]

Lais

[11] Patent Number: 4,601,466

[45] Date of Patent: Jul. 22, 1986

[54] EXERCISE WEIGHT

[75] Inventor: Edgar H. Lais, Weston, Canada

[73] Assignee: Global Gym & Fitness Equipment Limited, Weston, Canada

[21] Appl. No.: 469,916

[22] Filed: Feb. 25, 1983

[30] Foreign Application Priority Data

Jan. 6, 1983 [CA] Canada ..... 418983

[51] Int. Cl.[4] ..... A63B 21/00

[52] U.S. Cl. ..... 272/118

[58] Field of Search ..... 272/123, 122, 118; 29/237, 235; 308/DIG. 11; 384/441, 295, 296

[56] References Cited

U.S. PATENT DOCUMENTS

| | | | |
|---|---|---|---|
| 2,255,971 | 9/1941 | Hall | 384/296 X |
| 2,447,218 | 8/1948 | Trzesniewski | 272/123 |
| 2,470,815 | 5/1949 | Harvey . | |
| 2,640,696 | 6/1953 | Lemieux . | |
| 3,438,686 | 4/1969 | Stone | 384/296 |
| 3,905,599 | 9/1975 | Mazman . | |
| 4,322,071 | 3/1982 | Lambert et al. . | |
| 4,349,192 | 9/1982 | Lambert et al. . | |

FOREIGN PATENT DOCUMENTS

| | | | |
|---|---|---|---|
| 230794 | 12/1963 | Austria | 273/72 A |
| 8236414 | 12/1982 | Fed. Rep. of Germany . | |
| 1131300 | 10/1956 | France | 273/72 A |
| 520169 | 4/1940 | United Kingdom | 273/72 A |
| 809990 | 3/1959 | United Kingdom | 273/72 A |

*Primary Examiner*—Richard J. Apley
*Assistant Examiner*—Robert Bahr
*Attorney, Agent, or Firm*—Cushman, Darby & Cushman

[57] ABSTRACT

An exercise weight has an aperture extending therethrough which aperture is defined by an inner wall. The weight includes a locating flange extending inwardly of the inner wall. A resilient bushing of low-friction material is inserted into the aperture of the weight and is in slidably engageable with an elongate rod. The bushing has a peripheral wall and two locking flanges at the top and bottom of the peripheral wall which engage the locating flanges to preclude movement of the bushing relative to the weight in first and second opposing directions parallel to the longitudinal axis of the rod.

7 Claims, 10 Drawing Figures

EXERCISE WEIGHT

The present invention relates to exercise weights. In particular, the present invention relates to exercise weights which can be used in the weight stack of exercising machines.

When a plurality of weights are used in a weight stack, it is the present practice to core alternate weights for a bushing. The bushing permits the weight to slide along rods on which the weights are stacked. It is not necessary to core each weight to have a cored weight with a bushing because alternate uncored weights may be sandwiched between cored weights which tend to maintain the uncored weights in proper spatial relationship with respect to the weight support bar.

It is the present practice to make the weights from a casting. The weight is provided with one or more apertures into which the bushing is inserted. The bushing comprises a flat ring and has an edge portion thereof which abuts a seat formed in the inner wall of the weight. A groove is cast into the inner wall of the weight immediately below the bushing and a small gasket is inserted into the groove to hold the bushing against the seat and prevent movement of the bushing away from the seat. During or subsequent to the casting operation, however, the size and shape of the groove may be adversely altered by sand. As a result, the gasket may not properly fit in the groove causing the gasket and bushing to free themselves from the weight or the weight may be rejected.

The provision of cored and uncored weights also presents problems in production. There is a requirement to produce two types of weights, cored and uncored. There is a problem in ensuring that equal quantities of these weights are delivered. And there is the necessity of ensuring that the weights, cored an uncored are assembled alternately.

The irregularities in the bar mentioned previously may arise from bowing in the bar due to the forces to which they are subject or from production inconsistency. These irregularities apart from the increased resistance also lead to wear on both the weights and the rods which increases their maintenance costs.

It is therefore the principal object of the present invention to provide a bushing for a weight which is of reduced cost, more efficient and requires less maintenance.

It is another object of the present invention to provide a bushing which is not readily removable from a weight once it has been inserted therein.

According to a broad aspect of the present invention there is provided an exercise weight having at least one aperture defined by an inner wall and extending through the weight. The weight includes locating means extending inwardly of the inner wall. The exercise weight further includes bushing means insertable into the aperture for slidable engagement with an elongate rod passing through the bushing means. The bushing means has an outer peripheral wall and locking means extending outwardly from the peripheral wall for engagement with the locating means to preclude or inhibit substantial movement of the bushing relative to the weight in first and second opposing directions parallel to the longitudinal axis of the rod.

By providing the bushing means with locking means which engage the locating means on the exercise weight, the present invention eliminates the requirement of a gasket to hold the bushing means in place.

Additionally, the locating means of the weight may include at least one leading portion and one trailing portion. The locking means may comprise first and second locking flanges. One of the flanges may be resilient to pass over the leading portion. The leading portion may be so shaped to induce the one locking flange to deform as the bushing is being fitted into the aperture. Once the one locking flange passes the leading portion it snaps into locking engagement with the trailing portion. The shape of the peripheral wall and the first and second locking flanges may be complementary to the shape of the locating means. To facilitate the insertion of the bushing into the aperture, the one locking flange may be notched so that the one locking flange will not be continuous and include a slanted leading surface.

It is further contemplated that the peripheral wall of the bushing may have an outside dimension reduced with respect to the inside dimension of the locating means of the weight. This allows the bushing to float or move laterally relative to the weight and rod in a plane other than in the first and second opposing directions. By permitting the bushing to float in such a fashion, the bushing accommodates for the irregularities and inconsistencies in the rod and reduces wear.

The bushings also reduce the cost of weight production in that they permit the margin of error in the core to vary over a wider limit and reduce wastage.

Another advantage of the present invention resides in the fact that it is no longer necessary to provide two separate castings for the weights being cored with a bushing and the alternate uncored weights. Previous uncored weights had a smaller dimensioned central aperture than the cored weights so as to ensure that if an uncored weight was displaced radially of the other weights in the weight stack, its displacement would not be very much out of alignment. With the provision of the locating means of the present invention protruding inwardly, the necessity of making an uncored weight having a smaller dimensioned central aperture is negated. Therefore, by employing the teachings of the present invention, only one molding for the weight is required and as a result, the cost of manufacture of cored and uncored weights is reduced.

While the foregoing discussion relates to a weight having a bushing means it should be understood that in accordance with other aspects of the present invention, the invention may relate to the bushing or the weight, per se.

For a better understanding of the nature and objects of the present invention, reference may be had by way of example to the accompanying diagrammatic drawings in which.

Figure 1:
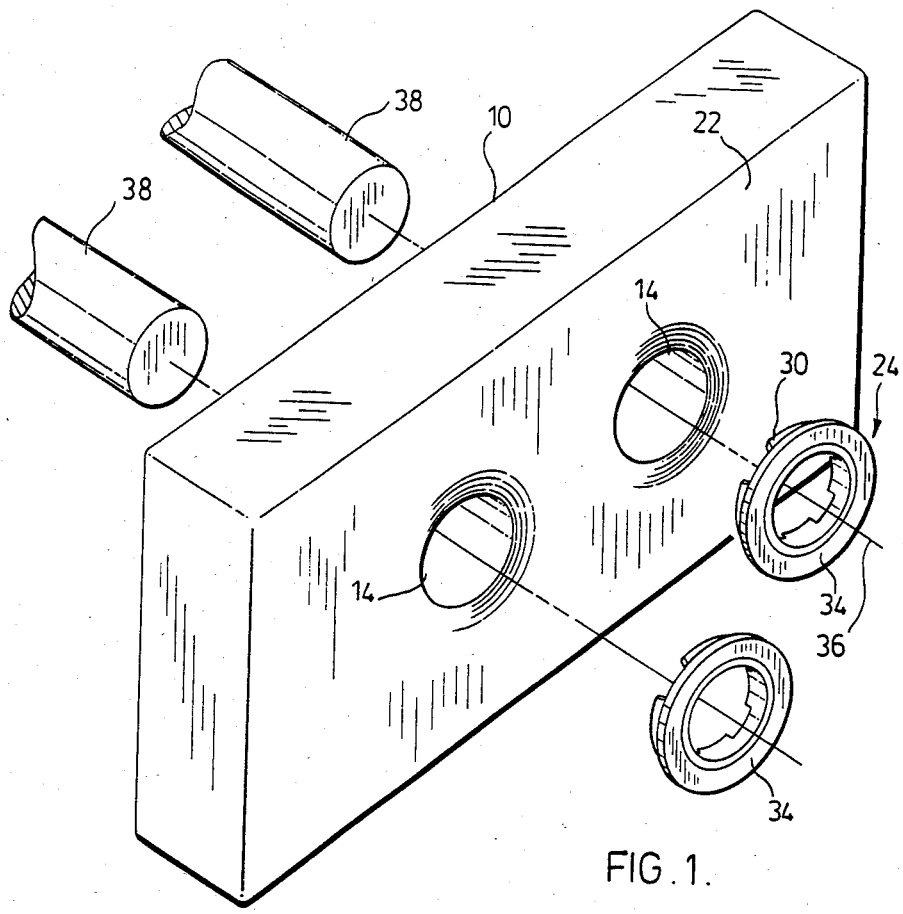
FIG. 1 is an exploded view of the weight of the present invention and the bushing insertable into the weight and weight bar.
Figure 2:
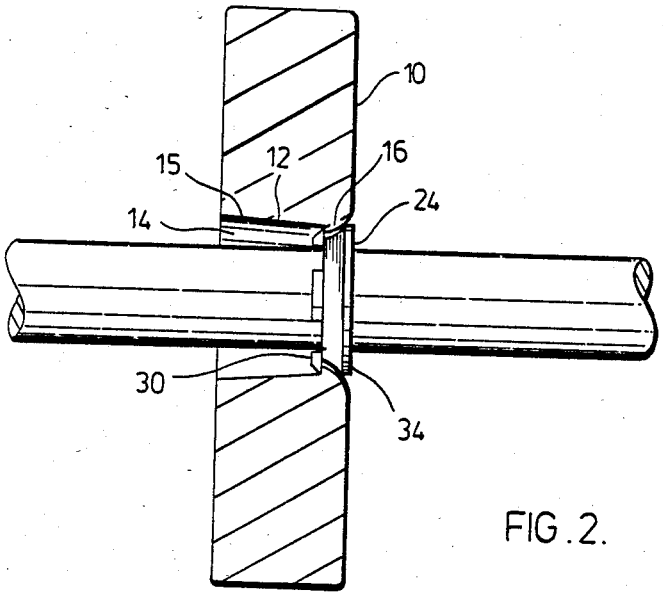
FIG. 2 is a side sectional view of the weight of the present invention including the bushing inserted therein.
Figure 3:
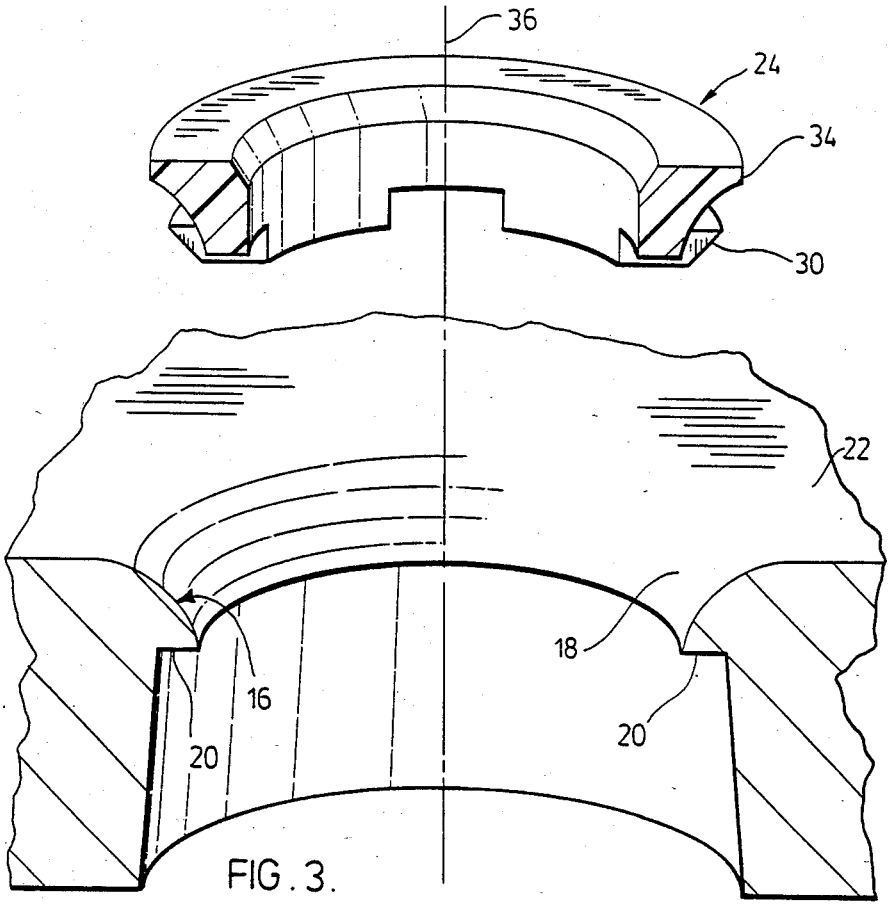
FIG. 3 is an enlarged perspective sectional view showing the bushing ready to be inserted into the weight of the present invention.
Figure 4:
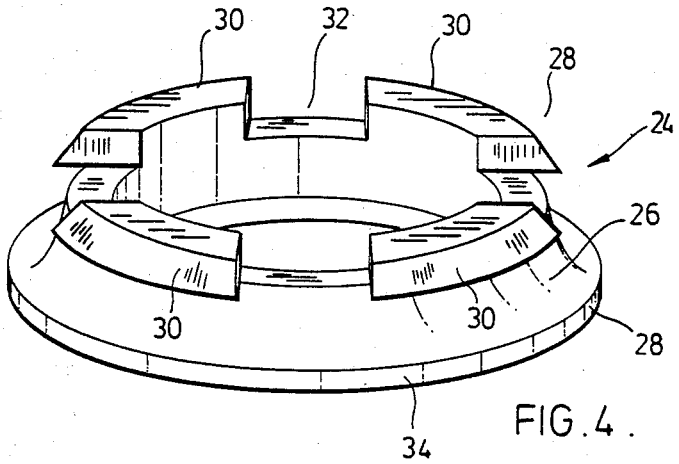
FIG. 4 is a perspective view showing the notched locking flanges of the present invention.

Referring now to FIGS. 1 through 4 the preferred embodiment of the present invention is described. An exercise weight 10 is illustrated as having two apertures. For the purposes of simplicity only one aperture and bushing therefor is described, it being understood that the other aperture is identical to the one described and is adapted in the same manner to receive a bushing. The exercise weight 10 includes an inner wall 12 defining an aperture 14 passing through the weight 10. The inner wall 14 is provided with an inwardly extending and continuous locating means or flange 16 which encircles the aperture 14. The locating flange is provided with an arcuate leading locating surface 18 and a trailing locating surface 20. As illustrated in FIGS. 2 and 3, the locating flange 16 is positioned adjacent one of the outer flat surfaces 22 of the weight 10. A portion 15 of the inner wall 12 is tapered to facilitate the casting of the weight.

A bushing 24 may be inserted into the aperture 14 of the weight 10. The bushing includes a peripheral wall 26 having locking means 28 extending outwardly from the peripheral wall 26. The locking means 28 comprise a first flange means 30 which is notched at 32 to provide a plurality of locking flanges 30. Each flange 30 has a leading surface which slopes at a predetermined angle upwardly and outwardly of the bushing. The angle of the slope is chosen to allow the flanges 30 to pass over locating means 16. The locking means 28 further includes a second flange 34.

The shape of the locking flanges 30 and 34 and the outer peripheral wall 26 is chosen to be complementary to the arcuate shape of the locating means 16 of weight 10.

Bushing 24 may be inserted into aperture 14 by pressing the bushing 24 into the aperture 14 of the weight along axis 36 of elongated weight support bar 38. During the insertion of the bushing 24 into the aperture 14, one of the locking flanges 30 temporarily deforms and passes over the leading surface portion 18 of the locating means and then snaps into engagement with the trailing surface 20. At this time, the second locking flange 34 engages the leading surface portion of the weight 10. As a result of the engagement of the locking flanges 30 and 34 with the locating means 16, the bushing 24 is prevented from moving substantially in a first and in a second opposing direction along the axis 36 and the outer peripheral wall 26 coextends with the locating means 16. As shown in FIG. 2 the bushing 24, when inserted in aperture 14, supports the weight 10 about elongated rod 38.

Because the shape of the peripheral wall 26 and locking flanges 28 is complementary to the shape of the locating means 16, it is extremely difficult if not impossible to force the bushing out of engagement with the locating means 16 of the weight.

As shown in FIG. 2, there is a slight gap between the outside of the bushing 24 and the locating means 16. This small gap is present because the outside dimension of the peripheral wall and locking flanges 30 and 34 is chosen to be slightly less than the inside dimension of the locating means 16. This permits the bushing to float substantially in a plane perpendicular to the axis 36 of the bar 38. As a result, the bushing compensates for any irregularities in the bar 38 as the weight 10 may be moved along the bar 38.

Referring now to FIGS. 5 through 9 alternate embodiments of the bushing and weight are shown.

Figure 5:
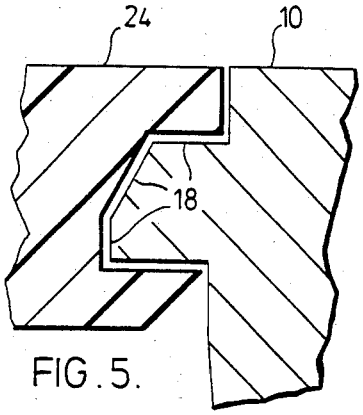
FIGS. 5 through 10 are sectional views of alternate embodiments showing the joining of the bushing within the weight.
Figure 6:
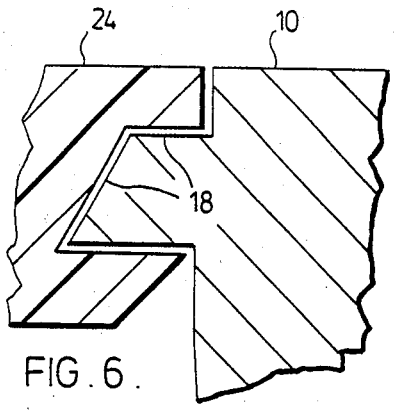

In FIGS. 5 and 6 the leading surface portion 18 of the locating means 16 is shown to comprise more than one surface.

Figure 7:
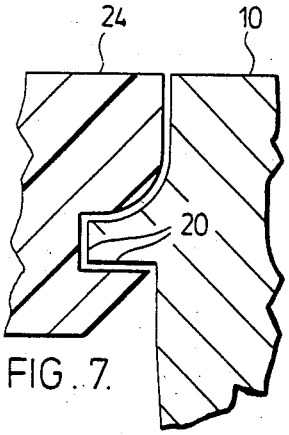

In FIG. 7 the leading surface of the bushing is shown as a convex arc and two trailing surfaces are shown at 20.

Figure 8:
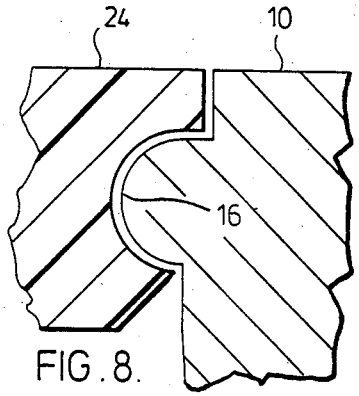

Referring to FIG. 8, one surface is shown for the locating means 16 such that the leading and trailing surfaces are in fact the same surface.

Figure 9:
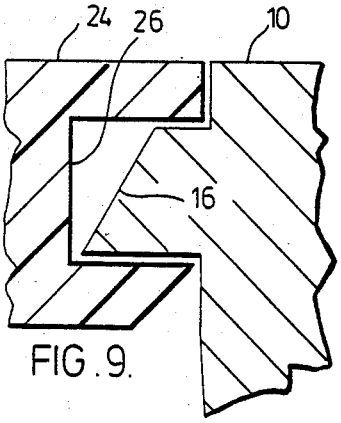

Referring to FIG. 9 there is shown a bushing whose outer peripheral wall 16 is not complementary to the shape of the locating means 16.

Figure 10:
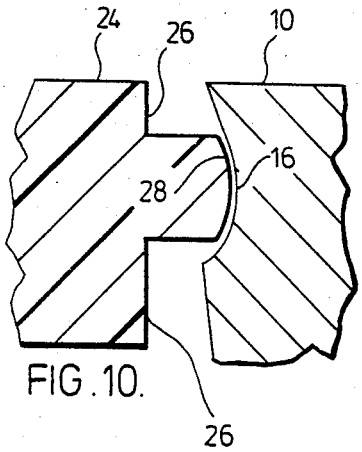

Referring to FIG. 10 there is shown a bushing and weight whose structure is the complement to the structure shown in FIG. 8.

In these embodiments, the dimensions of the bushing and weight must be such that the bushing can be inserted into the weight. In some instances, the bushing may be split such that it has a gap and is not a continuous ring. As a result, the bushing may be compressed for insertion into the weight aperture and, once inserted, the bushing springs back into engagement with the walls of the weight.

The material chosen for the bushing should be of suitable strength and flexibility to deform over the protruding locating portion of the weight and snap back into engagement with this portion. In the preferred embodiment, the bushing is made from nylon although it will be understood that any suitable material having low-friction characteristics and memory may be employed.

The embodiments of the present invention in which an exclusive property or privilege is claimed are defined as follows:

1. An exercise weight movable along an elongate rod, said weight comprising:
   - a body having an aperture therethrough and a bushing mounted in said aperture;
   - said aperture being defined by an inner wall;
   - locating means extending inwardly from said inner wall to engage said bushing and position it in said aperture;
   - said bushing having an inner wall defining a central opening, an outer peripheral wall, and locking means extending outwardly from said peripheral wall and engaging said locating means to substantially inhibit movement of the bushing relative to the body longitudinally of the aperture,
   - said outer peripheral wall conforming substantially in shape but being reduced in radial dimension with respect to
   - said locating means to permit said bushing to move laterally in the aperture relative to the weight-body and thereby accommodate irregularities in and rod when the weight is mounted thereon and moved therealong.

2. An exercise weight according to claim 1 wherein said locating means comprises at least a leading surface and a trailing surface, said locking means comprises first and second locking flanges which respectively engage said leading surface and said trailing surface, said second locking flange is resilient to pass over said leading surface when said bushing is inserted into said aperture and has a leading surface portion that slopes upwardly and outwardly of the bushing at a predetermined angle.

3. An exercise weight according to claim 2 wherein said leading surface has a continuous arcuate shape.

4. An exercise weight according to claim 2 wherein said locating means comprises a continuous locating flange encircling said peripheral wall and extending between said locking flanges.

5. An exercise weight according to claim 4 wherein said second locking flange is notched to facilitate its passage over the locating means.

6. An exercise weight according to claim 1 wherein said bushing has a length less than the thickness of said weight.

7. A weight for use in an exercise machine having a pair of elongate rods along which said weight is moved, said weight comprising:

a body having a pair of spaced apart apertures therethrough and a bushing mounted in each of said apertures, said apertures each being defined by an inner wall;

locating means extending inwardly from said inner wall to engage said bushing and position it in said aperture;

each said bushing having an inner wall defining a central opening therethrough, an outer peripheral wall; and locking means extending outwardly from said peripheral wall and engaging said locating means to substantially inhibit movement of the bushing relative to the body longitudinally of the aperture, said outer peripheral wall conforming substantially in shape but being reduced in radial dimension with respect to said locating means to permit said bushings to move laterally in said apertures relative to the weight-body and thereby accommodate irregularities in the rods when the weight is mounted thereon and moved therealong.

* * * * *